US007534390B2

(12) United States Patent
Khloponin et al.

(10) Patent No.: US 7,534,390 B2
(45) Date of Patent: May 19, 2009

(54) TUYERE DEVICE FOR INTRODUCING GASEOUS MEDIA UNDER A LIQUID-METAL LAYER

(75) Inventors: Viktor Nikolaevich Khloponin, Moscow (RU); Evald A. Shumaher, München (DE); Edgar E. Shumaher, München (DE); Renata Francki, München (DE)

(73) Assignee: Techcom Import Export GmbH, Munich (DE)

( * ) Notice: Subject to any disclaimer, the term of this patent is extended or adjusted under 35 U.S.C. 154(b) by 372 days.

(21) Appl. No.: 10/561,011

(22) PCT Filed: Jun. 4, 2004

(86) PCT No.: PCT/RU2004/000217

§ 371 (c)(1), (2), (4) Date: Mar. 6, 2006

(87) PCT Pub. No.: WO2004/111276

PCT Pub. Date: Dec. 23, 2004

(65) Prior Publication Data

US 2007/0096373 A1 May 3, 2007

(30) Foreign Application Priority Data

Jun. 16, 2003 (RU) ..... 2003117356

(51) Int. Cl.
*C21C 5/48* (2006.01)

(52) U.S. Cl. ..... 266/270; 266/268

(58) Field of Classification Search ..... 266/266, 266/267, 268, 270

See application file for complete search history.

(56) References Cited

U.S. PATENT DOCUMENTS 4,417,723 A * 11/1983 Kitamura et al. ..... 266/266
4,449,701 A * 5/1984 Pitzer et al. ..... 266/270

* cited by examiner

*Primary Examiner*—Scott Kastler
(74) *Attorney, Agent, or Firm*—Notaro & Michalos P.C.

(57) ABSTRACT

A tuyere device for introduction of gaseous media under a liquid metal layer comprises a nest block made of refractory material provided with a sleeve incorporated therein, Coaxial metal tubes with at least one central channel and at least one annular channel which are arranged on the side thereof for entering a liquid metal and separately connected to inlets for supplying gaseous media to the metal. The coaxial tubes consist of two sections having different diameters. The first section has a smaller diameter and is used for supplying the gaseous media to the liquid metal. The second section has a larger diameter and is connected to the inlets for supplying gaseous media to the channels of the first section. The second section is also provided with an additional internal tube. The internal tube of the first section is closed on the both ends and filled with a refractory material. The invention provides a possibility to exclude metal break through the operating channels.

8 Claims, 2 Drawing Sheets

TUYERE DEVICE FOR INTRODUCING GASEOUS MEDIA UNDER A LIQUID-METAL LAYER

FIELD AND BACKGROUND OF THE INVENTION

Figure 1:
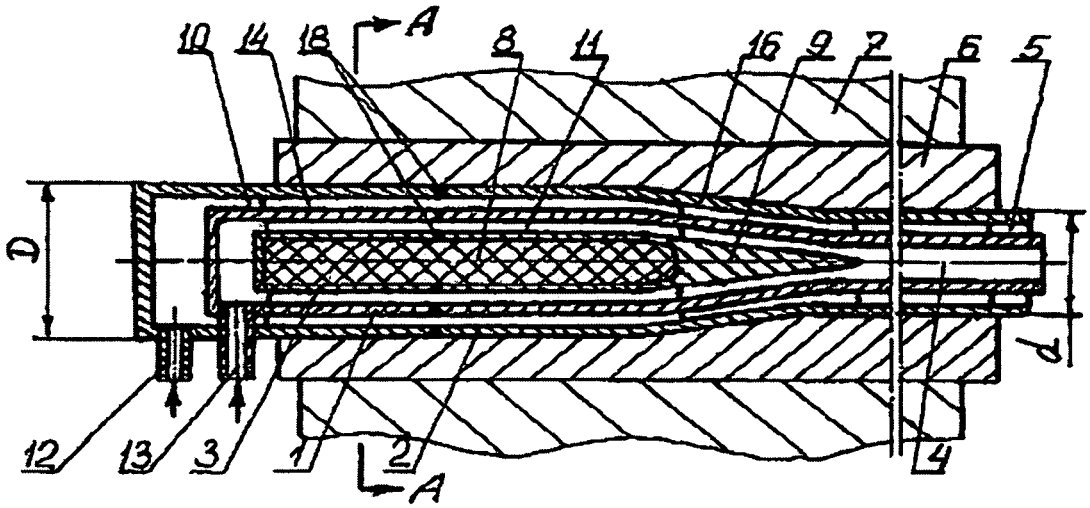

The invention relates to producing and processing liquid metal in metallurgy, and, more particularly, to the manufacture of steel in ferrous metallurgy.

In the recent years technologies of producing liquid metal in metallurgy, especially in ferrous metallurgy, have been improved due to the methods of introducing various media under a liquid-metal layer and wide application of various gases to form such media. Argon, nitrogen, oxygen in combination with methane and nitrogen admixtures, have been used as such gases.

The abovementioned technological step enables to intensify homogenization of liquid metal as well as to accelerate the process of metal finishing. Steel blowing, in particular, is widely applied in steel-making and finishing techniques. A tuyere-based blowing device is applied to inject a gas into the furnace. A corresponding tuyere of such blowing device usually comprises metal tubes inside which gas-bearing operating channels are provided. A tuyere device provided with a blowing element intended for lateral oxygen injection, is widely used. In this case the central operating oxygen supply channel (intended also for supplying oxygen containing a nitrogen admixture) encompasses an operating annular channel to supply, for example, methane with a $CH_4$ nitrogen admixture.

Continuous supplying of gas into the liquid steel has become the main problem in technologies of lateral oxygen injecting into liquid metal under a liquid-metal layer. Any interruption in gas supply results in entering liquid steel in operating channels and break-out of steel outside a steel containing unit. All the above mentioned requires guaranteed protection against steel break-outs through a steel containing unit.

Known is a blowing element of a steel making unit, which itself represents a solution to the mentioned problem, The blowing unit contains a series of interconnected sections of straight tubes providing gas bearing channels. The said sections of tubes contain portions with a capillary and a gas bearing channels (e.g., KNABL "Annual Refractory Symposium. 1 . . . 5 of July 2002). The essential drawback of this blowing unit known from the prior art is that such device can not be used to supply oxygen into a portion located below the liquid metal layer.

Known is a tuyere device designed for lateral oxygen supply below the liquid-metal layer. The tuyere contains a nest block made of refractory material incorporating an embedded sleeve. The socket unit contains a bush formed by coaxial metal tubes provided, on the side intended for introducing the liquid metal, at least one central operating channel and at least one annular operating channel, said channels being independently connected to gas supplies (e.g. EP 0 565 690 B1). This tuyere known from the prior art is very close to the inventive device with regard to essential features and has been selected as a prototype of the invention. An essential drawback of this tuyere consists in a lack of any substantial protection against break-out of a liquid metal through the operating channels. A tuyere designed in accordance with the present invention overcomes the above-described drawbacks of the prior art.

SUMMARY OF THE INVENTION

It is therefore an object of the present invention to provide a tuyere featuring efficient protection against break-out of the liquid metal through the operating channels, has been solved in the inventive device.

The technological object is attained with the tuyere device of the present invention intended for introducing gaseous media under a liquid-metal layer. Such tuyere device comprises a nest block made of refractory material, said block being provided with a sleeve incorporated therein and formed by coaxial metal tubes provided with at least one central operating channel and at least one annular operating channel which are arranged on the side thereof intended for introduction into liquid metal, and are separately connected to inlets for supplying gaseous media to liquid metal, wherein said coaxial metal tubes consist of two interconnected sections having different diameters, the first section having a smaller diameter and being intended for supplying the gaseous media to the liquid metal, and the second section having larger diameter and being connected to gas supply inlets for separate supplying the gaseous media to the operating channels of the first section, whereas the second section is provided with an additional metal tube and with annular operating channels only, while the internal tube of said section is closed on the both ends thereof and filled with a refractory material, the gaps of said annular operating channels in this section of the tuyere being embodied in the form of capillaries for the liquid metal.

In addition, the annular operating channels pertaining to the second section of the sleeve in the sections of passing into the sleeve's first section operating channels are outlined by straight conical surfaces with smooth conjunction in the passage ends, and at least on the portion of such passage the end portion of the said internal tube passes into a conical rod coaxially located in the central operating channel of the first section.

Further, the annular channels of the coaxial metal tube' second section on the portions of passing to the first section's operating channels are spherically surfaced with smooth end conjunction in the passage ends, whereas at least on the portion of said passage the end portion of the internal tube passes to a conical rod located coaxially in the central operating channel of the first section. In addition, the annular operating channels in the second section of the sleeve are calibrated by means of placing between the tubes of a gauge spring having initial diameter lesser than the external diameter of a tube incorporating such a gauge spring. Further, the internal tube of the second section of the coaxial metal tubes is provided with calibrated ribs across external diameter thereof, including on the portion of the passage between the coaxial tubes second section and the first section. Moreover, an annular weld seam is provided in the tubes sleeve's second section.

The object attained, and advantages offered by the present invention will become more apparent from the description that now follows in conjunction with the accompanying schematic drawings.

BRIEF DESCRIPTIONS OF THE DRAWINGS

FIG. 1 is a schematic illustration of the longitudinal section of the inventive tuyere.

Figure 2:
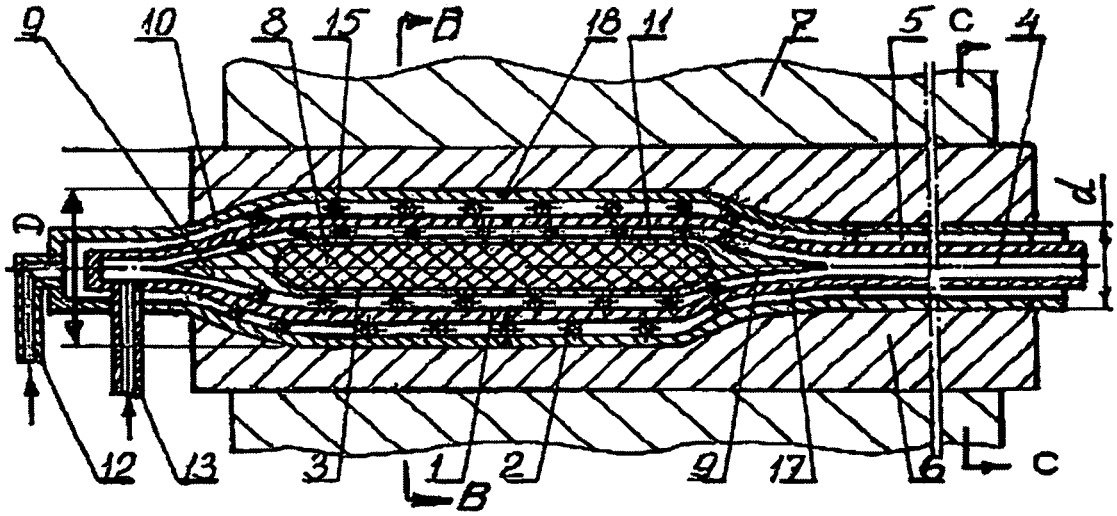

FIG. 2—is a schematic illustration of the longitudinal section of an embodiment of the tuyere disclosed herein.

Figure 3:
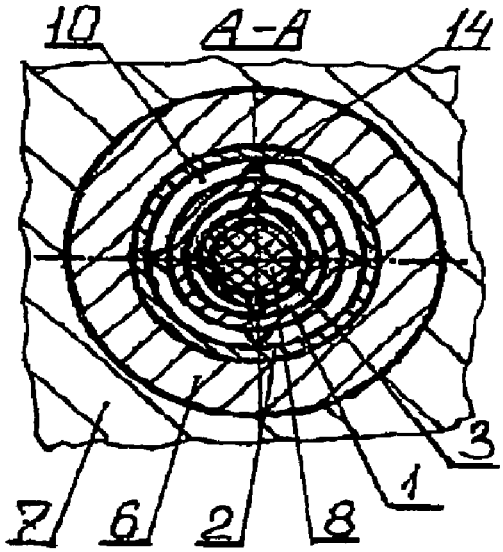

FIG. 3—is a cross-section of the device shown on FIG. 1 along the A-A' line.

Figure 4:
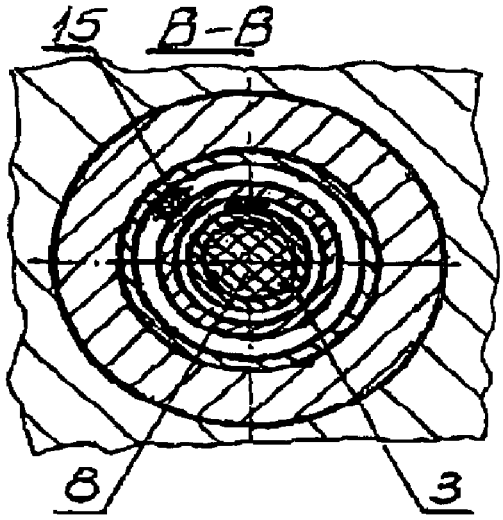
Figure 5:
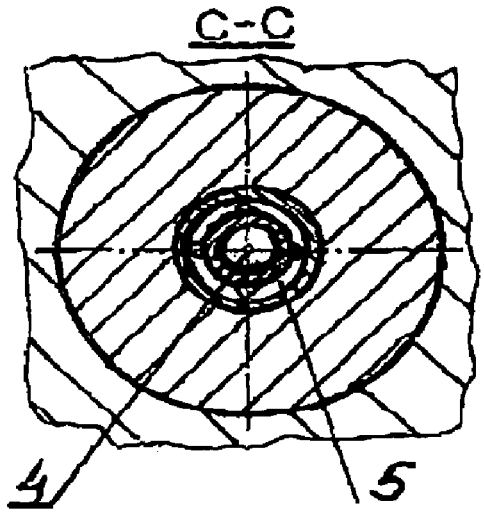

FIG. 4—is a cross-section of the device shown on FIG. 2 along the B-B' line, and FIG. 5—is a cross-section a cross-section of the device shown on FIG. 2 along the C-C line (similar to the view presented on FIG. 1).

DETAILED DESCRIPTION OF THE INVENTION

The tuyere comprises coaxial metal tubes 1 and 2 on the side intended for introducing into the liquid metal. The outer diameter of the tube 2 is indicated by the letter d on Fig. FIGS. 1 and 2. This relates to the first section of the coaxial metal tubes.

In the second section these metal tubes have diameter greater than d and indicated as D for the external tube 2. The central tube 3 closed on its ends, is located between the tubes 1 and 2. On the side intended for injecting, the tubes 1 and 2 form the central operating channel 4 and the annular operating channel 5. The tubes are walled up in the sleeve 6 located in the nest block 7. The central tube 3 is filled with a refractory material 8. The end of the central tube 3, at least, on the side of the central operating channel 4 passes into the conical rod 9 entering the channel 4, and is placed coaxially with this channel (FIGS. 1 and 2). In one of embodiments the central tube 3 can have its ends in the form of a conical rod 9 (FIG. 2).

The annular operating channels 10 and 11 connected to the operating channels 5 and 4, respectively, are provided between the tubes in the second section of the coaxial metal tubes having larger diameter D. The operating annular channels 10 and 11 are independently provided with inlets for gas supply. Thus, the gas is supplied to the channel 10 through the tube 12, and to the channel 11 through the tube 13 (the supply routes are marked by arrows on FIGS. 1-2).

The operating channels 4, 5, 10 and 11 are calibrated. Ribs 14 of various configurations or a gauge spring 15 are executed on the annular channels 5, 10 and 11. In the same time, the passage portions 16 (FIG. 1) and 17 (FIG. 2) provided between the second and the first section of the coaxial metal tubes, are also affected by either ribs 14 or a spring 15. In the spring 15, this position is enabled by applying springs of smaller inner diameter comparing to the outer diameter of the appropriate tube.

The following combination can also be applied: calibrated ribs 14 in the annular gap 10 are combined with the gauge springs 15 in the annular gap 11, and vice versa. The passage between these two sections of the coaxial metal tubes can be executed in the form of a conical surface 16 (FIG. 1) or a spherical surface 17 (FIG. 2). In any of the embodiments, the passage is provided to implement a smooth conjunction on the passage ends.

The cross-section of the annular channels 10 and 11 is equal to or slightly exceeds the cross-section of the channels to which they are independently connected, i.e. channel 10 is connected to the channel 5, and the channel 11 is connected to the channel 4. However, in all embodiments the annular gaps of the channels 10 and 11 are provided in the form of "capillaries" for the liquid metal into which gaseous media are injected. The "capillary" shall mean a narrow gap preventing passing of a liquid metal through such gap. The capillary gaps of 1.5-2 mm and less can be applied in melting and finishing installations to admit liquid steel.

In conformity with installation technologies, the annular welded seams 18 are made on metal tubes of the second section of the device disclosed herein.

The tuyere for introducing gaseous media under the liquid-metal layer designed in accordance with the present invention operates in the following way.

The nest block 7 with a sleeve 6 and steel tubes 1, 2 and 3 in the form shown in Fig. FIGS. 1 and 2 are installed in the laying of a device in which a liquid metal is manufactured or processed. To intensify the manufacture (metal melting or finishing), a gaseous oxygen is injected into the metal. The injection is performed below the level of liquid metal (for example in steel-making processes carried out in electric arc furnaces or blast furnaces). The gaseous oxygen is supplied through the tube 13. In some applications the oxygen is mixed with a certain amount of nitrogen. The oxygen through the annular operating channel 11 is supplied to the central channel 4 and further into the liquid metal. Due to the calibrated ribs 14, the oxygen is uniformly supplied into the channel 4. In case a gauge spring 15 is used, the twisted oxygen stream is supplied into the liquid metal, which improves interaction between the metal and the gas.

Methane, or methane with a nitrogen admixture, is supplied through the tube 12, from which the gas through the annular channel 10 flows into the annular channel 5 and further into the liquid metal where it encompasses the oxygen stream supplied into the metal via the central channel 4. This excludes fast burn-out of the sleeve 6 in the nest block 7 and of the furnace laying.

The smooth passages 16 (or 17) and the conical rod 9 entering the central operating channel 4 prevent failures and breaks of the supplied gas stream. Acceleration of oxygen supply towards the metal is achieved through appropriate selection of the ratios of cross-sections of the calibrated channel 11 and the central channel 4. Due to pressure overfall effect, the tube 3 is pressed to the tube 1 through the ribs 14 or the spring 15. In the similar way the tube 1 is pressed to the tube 2. In both cases the tubes are pressed on the passages 16(17).

If the oxygen supply is interfered (or by some other reasons), the liquid metal (molten steel) flows into the central channel 4. The annular operating channels 10 and 11, being calibrated and provided With the gaps performing the function of capillaries admitting the liquid metal, having sizes of between 1.5 and 2 mm (for steel), prevent further flow of the molten metal. The effect of preventing molten metal breakouts is enforced by melting of the refractory material 8.

Thus, the use of the offered tuyere for introducing gaseous media under a liquid-metal layer, ensures to prevent the molten metal break through the tuyere operation section.

The invention claimed is:

1. A tuyere device for introducing gaseous media under a liquid-metal layer, comprising;

a nest block made of refractory material, said block being provided with a sleeve incorporated in the block including coaxial metal tubes defining at least one central operating channel and at least one annular operating channel which are arranged on a first side of the block for introduction into liquid metal, and are separately connected to inlets for supplying gaseous media to the liquid metal on an opposite second side of the block;

said coaxial metal tubes along their length consisting of two interconnected sections having different diameters, the first section being at the first side of the block and having a smaller diameter and being for supplying the gaseous media to the liquid metal and the second section being at the second side of the block and having a larger diameter than said first section and being connected to gas supply inlets for separately supplying the gaseous media to the operating channels of the first section;

the second section including an additional central metal tube defining an annular operating channel only with an inner one of the coaxial metal tubes, the central tube of said second section being closed on both ends thereof and filled with a refractory material, gaps of said annular operating channels in said second section being capillaries for the liquid metal.

2. The tuyere device of claim 1, wherein the annular operating channels, provided in the second section of the coaxial metallic tubes, on the portions of passage into the operating channel's first section are outlined by straight conical surfaces featuring smooth conjunction in the passage ends and the end portion of the internal tube at least on said passage portion, passes into a conical rod coaxially located in the central operating channel of the first section.

3. The tuyere device of claim 1, wherein the annular channels of the coaxial metal tubes' second section feature spherical surface, providing also smooth passage, end conjunction on the portions of passing into the first section's operating channels, whereas the end portion of the internal tube at least on this passage portion passes to a conical rod located coaxially in the central operating channel of the first section.

4. The tuyere device of claim 1, wherein the annular operating channels are calibrated in the second section of the sleeve by means of placing between the tubes a gauge spring having initial diameter less than the external diameter of the tube on which such spring is installed.

5. The tuyere device of claim 1, wherein the inner one of the coaxial tubes of the second section of the coaxial metal tubes is provided with calibrated ribs located across its external diameter, whereas such calibrated ribs are provided also on the portion of passage of the coaxial metal tubes' second section into the first section.

6. The tuyere device of claim 1, wherein the sleeve's second section tubes are provided with an annular weld seam.

7. A tuyere device for introducing gaseous media under a liquid-metal layer, comprising:

a nest block made of refractory material, said block being provided with a sleeve incorporated in the block including coaxial metal tubes defining at least one central operating channel and at least one annular operating channel which are arranged on a first side of the block for introduction into liquid metal, and are separately connected to inlets for supplying gaseous media to liquid metal on an opposite second side of the block;

said coaxial metal tubes along their length consisting of two interconnected sections having different diameters, the first section being at the first side of the block and having a smaller diameter and being for supplying the gaseous media to the liquid metal and the second section being at the second side of the block and having a larger diameter than said first section and being connected to gas supply inlets for separately supplying the gaseous media to the operating channels of the first section;

the second section including an additional central metal tube defining an annular operating channel only with an inner one of the coaxial metal tubes, the central tube of said second section being closed on both ends thereof and filled with a refractory material, gaps of said annular operating channels in said second section being capillaries for the liquid metal;

the diameter of said coaxial metal tubes decreasing in a consistent and gradual manner in a passage from said second section toward said first section; and at least one end of the central tube of said second section on said passage, becomes a conical rod coaxially located in the central operating channel of the first section.

8. The tuyere device of claim 7, wherein the diameter of said coaxial metal tubes decrease in straight conical surfaces or in spherical surfaces, and both ends of the central tube are conical rods coaxially located in the central operating channel.

* * * * *